US012480059B2

(12) United States Patent
Jørgensen

(10) Patent No.: US 12,480,059 B2
(45) Date of Patent: Nov. 25, 2025

(54) PROCESS FOR TREATING A FEEDSTOCK COMPRISING HALIDES

(71) Applicant: TOPSOE A/S, Kgs. Lyngby (DK)

(72) Inventor: Lars Jørgensen, Kgs. Lyngby (DK)

(73) Assignee: TOPSOE A/S, Kgs. Lyngby (DK)

( * ) Notice: Subject to any disclaimer, the term of this patent is extended or adjusted under 35 U.S.C. 154(b) by 0 days.

(21) Appl. No.: 18/252,100

(22) PCT Filed: Nov. 11, 2021

(86) PCT No.: PCT/EP2021/081366
§ 371 (c)(1),
(2) Date: May 8, 2023

(87) PCT Pub. No.: WO2022/101333
PCT Pub. Date: May 19, 2022

(65) Prior Publication Data

US 2023/0407195 A1 Dec. 21, 2023

(30) Foreign Application Priority Data

Nov. 13, 2020 (EP) ..... 20207450

(51) Int. Cl.
*C10G 67/14* (2006.01)
*C10G 1/00* (2006.01)

(52) U.S. Cl.
CPC ..... *C10G 67/14* (2013.01); *C10G 1/002* (2013.01); *C10G 2300/1003* (2013.01);
(Continued)

(58) Field of Classification Search
CPC ..... C10G 1/002; C10G 19/02; C10G 2300/1003; C10G 2300/201;
(Continued)

(56) References Cited

U.S. PATENT DOCUMENTS 3,356,608 A * 12/1967 Franklin ..... C10G 45/08 208/103
4,141,816 A * 2/1979 Crowley ..... C10G 47/00 208/213

(Continued)

FOREIGN PATENT DOCUMENTS

CN 110218579 A * 9/2019
WO 2014033733 A1 3/2014

(Continued)

OTHER PUBLICATIONS

CN-110218579—A English Translation (Year: 2019).*

(Continued)

*Primary Examiner* — Ellen M Mcavoy
*Assistant Examiner* — Chantel Graham
(74) *Attorney, Agent, or Firm* — Boone IP Law

(57) ABSTRACT

A process and a system for conversion of a hydrocarbonaceous feed comprising at least 10 ppmw and less than 10000 ppmw of one or more halides, and at least 20 ppmw and less than 10000 ppmw organically bound nitrogen, to a hydrocarbon product stream by hydrotreatment, in the presence of a material catalytically active in hydrotreatment and an amount of hydrogen, wherein said hydrocarbon product stream comprises an amount of ionic halides and an amount of ammonia, said process including:

a) separating in a first separation step at a first separation temperature the mixed product stream to provide an overhead stream and a bottoms stream,
b) combining the overhead stream with an amount of wash water and
c) separating in a second separation step the combined overhead stream and wash water in a non-polar stream of hydrocarbon product and a polar stream of wash water comprising ammonium halides.

12 Claims, 1 Drawing Sheet

(52) U.S. Cl.
CPC ..... *C10G 2300/202* (2013.01); *C10G 2300/4006* (2013.01); *C10G 2300/805* (2013.01)

(58) Field of Classification Search
CPC ..... C10G 2300/202; C10G 2300/4006; C10G 2300/805; C10G 31/08; C10G 45/02; C10G 45/04; C10G 45/34; C10G 65/06; C10G 67/02; C10G 67/14; Y02P 30/20; C12Q 1/6827; C12Q 1/6853; C12Q 1/686; C12Q 1/6883; C12Q 2521/125; C12Q 2525/117; C12Q 2525/155; C12Q 2537/164; C12Q 2600/118; C12Q 2600/154
See application file for complete search history.

(56) References Cited

U.S. PATENT DOCUMENTS 5,618,407 A * 4/1997 Kallenbach ..... C10G 11/04 208/113
2019/0062646 A1 2/2019 Hakeem et al.

FOREIGN PATENT DOCUMENTS

WO 2015050635 A1 4/2015
WO WO-2016150600 A1 * 9/2016
WO 2020254629 A1 12/2020
WO WO-2021118334 A1 * 6/2021 ..... A23D 9/02

OTHER PUBLICATIONS

International Search Report (PCT/ISA/210) and Written Opinion (PCT/ISA/237) mailed on Jan. 24, 2022, by the Patent Office as the International Searching Authority for International Application No. PCT/EP2021/081366. (17 Pages).
Search Report mailed on May 3, 2021, by the European Patent Office for Application No. 20207450.6. (17 pages).
Notification of a Third Party Observation mailed on Oct. 24, 2024, by the European Patent Office for European Application No. 21802773.8, 16 pages.

* cited by examiner

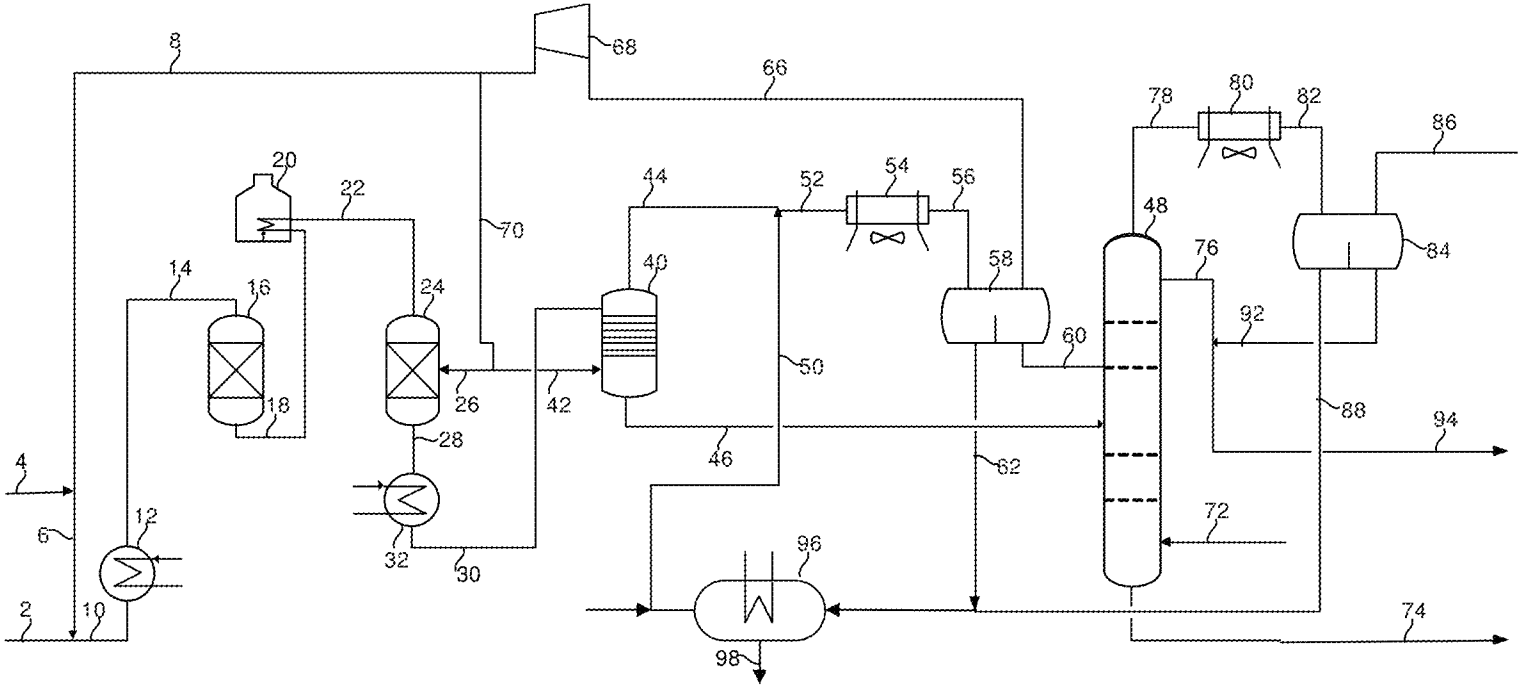
2
4
6
8
10
12
14
16
18
20
22
24
26
28
30
32
40
42
44
46
48
50
52
54
56
58
60
62
66
68
70
72
74
76
78
80
82
84
86
88
92
94
96
98

PROCESS FOR TREATING A FEEDSTOCK COMPRISING HALIDES

FIELD OF THE INVENTION

This invention relates to a process and a system for conversion of a hydrocarbonaceous feed comprising halides and nitrogen, and specifically a process and a system for removing ammonium halides from a hydrocarbon stream comprising ammonia and one or more halides.

BACKGROUND OF THE INVENTION

Refinery and petrochemical processes comprise a plurality of treatments of hydrocarbon rich streams in order to provide products or intermediates in the form of LPG, naphtha, gasoline, diesel, etc. Such treatments comprise hydro-treatment, hydro-cracking, steam-cracking, fractionation and stripping, as well as intermediate heat exchange and removal of impurities.

Hydrocarbonaceous feedstock may, depending on origin, contain heteroatoms, undesired in the downstream processing. The most abundant heteroatoms are sulfur, nitrogen and, oxygen, which may be present in concentrations from 100 $ppm_w$ to 10 wt %, and for oxygen in some biological materials even as high as 45 wt %. These heteroatoms are in refinery hydrotreatment processes converted into hydrogen sulfide, ammonia, water and carbon oxides, which cause few challenges in the process plants. Other heteroatoms are typically metals, which typically are present in small amounts (0-10 $ppm_w$) and precipitate on catalyst guard particles, and thus also cause few challenges in the process plants. However, when treating biomass or waste products such as plastic waste, some heteroatoms may be present in much higher concentrations than in fossil feedstocks. For thermally decomposed waste, e.g. pyrolyzed plastic, the content of e.g. Cl may be 1000 $ppm_w$ or higher, and after hydrotreatment the organic Cl will have been converted to HCl which may cause corrosion issues, especially if the acidity of HCl is not neutralized by presence of e.g. $NH_3$. It is therefore important to remove the heteroatoms early in the process, to minimize the effect on down-stream process steps. Similar issues may also be observed for biomass comprising halides, e.g. if originating from salt water.

WO 2015/050635 relates to a process for hydrotreating and removing halides from a hydrocarbon stream by hydrotreatment. The document is silent on the amount of water required for withdrawal of halides from the process and on the practical aspects of the process, except for an emphasis on the materials used being corrosion resistant.

In addition to halides notably nitrogen is also present in the hydrocarbons feedstocks. During hydrotreatment organically bound nitrogen is converted to ammonia. Ammonia and halides may react to form salts, e.g. ammonium chloride, which is a solid at temperatures below the precipitation temperature which typically is 150° C. to 300° C. Precipitation of such salts may result in partial or complete blocking of process lines as well as potential corrosion and must therefore be avoided. Therefore, it is important to ensure the process temperature to be above the precipitation temperature.

From 30% or 80% to 90% or 100% of the organic halides in a hydrocarbonaceous feedstock, may be converted to inorganic halides in a hydrocarbon product stream by one embodiment of the disclosure. The hydrocarbon product is washed with water which dissolves inorganic halides and ammonia and may be separated from the hydrocarbon stream.

By the washing with water, the inorganic halides from the hydrocarbon stream are removed from the product. These inorganic halides removed from the hydrocarbon stream may be taken away from the system in a dilute aqueous wash water solution, or e.g. by regenerating the wash water by evaporation, membrane separation, reverse osmosis or other means of concentrating the impurities in a brine.

In an embodiment, a make-up hydrogen stream is added to the hydrogen rich gas phase prior to the recycling into the hydrotreatment reactor. This is in order to ensure the required hydrogen to be present within the hydrotreatment reactor for the conversion of organic halides into inorganic halides, and possibly also further reactions, such as olefin saturation.

Where concentrations are stated in wt % this shall be understood as weight/weight %, and similarly $ppm_w$ as parts per million by mass.

Throughout this text, the term "a material catalytically active in converting organic halides into inorganic halides" is meant to denote catalyst material arranged for and/or suitable for catalyzing the conversion to a commercially relevant extent.

"Organic halides" are chemical compounds in which one or more carbon atoms are linked by covalent bonds with one or more halogen atoms (fluorine, chlorine, bromine, iodine or astatine—group 17 in current IUPAC terminology).

"Inorganic halides" are chemical compounds between a halogen atom and an element or radical that is less electronegative (or more electropositive) than the halogen, to make a fluoride, chloride, bromide, iodide, or astatide compound, with the further limitation that carbon is not part of the compound. A typical example of a material catalytically active would be a classical refinery hydrotreatment catalyst, such as one or more sulfided base metals on a refractive support.

The term "removing halides" is meant to include situations where either some or all of the halides present in organic form are converted into inorganic halides, and subsequently removed. The term is thus, unless otherwise indicated, not limited to situation where a certain percentage of the halides present are removed.

The term "react at the presence of the catalytically active material" is meant to cover bringing a stream into contact with the catalytically active material under effective conditions for the implied catalytic reaction to take place. Such conditions typically relate to temperature, pressure and stream composition.

The term "precipitation temperature" of ammonium halides is meant to cover the temperature (under the given conditions, such as concentration and pressure) at which gaseous ammonia and gaseous inorganic halides (typically hydrogen halides) precipitate, either by reacting to form solid ammonium halide crystals or dissolved in condensed water. For ammonium chloride in concentrations above 500 $ppm_w$ and a pressure of 100 Barg this temperature is 280° C. as an example, and typically for the relevant conditions this temperature will be in the range 150-300° C.

The term "thermal decomposition" shall for convenience be used broadly for any decomposition process, in which a material is partially decomposed at elevated temperature (typically 250° C. to 800° C. or perhaps 1000° C.), in the presence of substoichiometric amount of oxygen (including no oxygen). The product will typically be a combined liquid and gaseous stream, as well as an amount of solid char. The term shall be construed to included processes known as pyrolysis, partial combustion, or hydrothermal liquefaction.

The unit "Barg", shall in compliance with the practice of the field be used to denote Bar, gauge, i.e. the pressure relative to atmospheric pressure.

BRIEF SUMMARY OF THE INVENTION

A broad aspect of the present disclosure relates to a process for conversion of a hydrocarbonaceous feed comprising at least 10 $ppm_w$, 100 $ppm_w$ or 500 $ppm_w$ and less than 1000 $ppm_w$, 5000 $ppm_w$ or 10000 $ppm_w$ of one or more halides, and at least 20 $ppm_w$, 100 $ppm_w$ or 500 $ppm_w$ and less than 1000 $ppm_w$, 5000 $ppm_w$ or 10000 $ppm_w$ organically bound nitrogen, to a hydrocarbon product stream by hydrotreatment, in the presence of a material catalytically active in hydrotreatment and an amount of hydrogen, wherein said hydrocarbon product stream comprises an amount of ionic halides and an amount of ammonia, said process comprising the steps of a) separating in a stripping process at a first separation temperature the mixed product stream to provide an overhead stream and a bottoms stream,
b) combining the overhead stream with an amount of wash water and
c) separating in a second separation step the combined overhead stream and wash water in a non-polar stream of hydrocarbon product and a polar stream of wash water comprising ammonium halides, characterized in that the first separation temperature being above the precipitation temperature of the ammonium halides present in the mixed product stream.

This has the associated benefit of such a method removing halides, especially chloride from the bottoms stream from the first separation step and subsequently from the nonpolar stream of the second separation step, while maintaining a temperature where ammonia and halides are gaseous until an amount of water is available to collect ammonium halides in solution, and thus avoid precipitation of solid ammonium halides on the inner surfaces of the process equipment, by either keeping it in the gas phase or dissolved in liquid water. Furthermore, by the separation before the addition of wash water, the amount of hydrocarbons associated to the stream to be washed by an amount of water is reduced, and thus amount of water required for this washing is also reduced.

In a further embodiment said stripping process employs hydrogen, steam, methane or nitrogen as a stripping medium. These stripping media have the associated benefits of being available in specific processes. Hydrogen is also a reagent and may be beneficial since no additional reagents are added to the process and as such it is the preferred stripping medium. Steam may be conveniently compatible with the later water addition and methane and nitrogen may also be beneficial due to availability in specific processes.

In a further embodiment the temperature of said first separation step is above 280° C., 300° C. or 320° C. This choice of temperature has the benefit of being conveniently above the precipitation temperature of the ammonium halides, such that these are maintained in gas phase until combination with water.

In a further embodiment the temperature of said first separation step is below the temperature at which 30%, 50% or 80% of the mixed product stream boils. This choice of temperature has the benefit of ensuring that at least 70%, 50% or 20% of the mixed product stream is withdrawn as a liquid from the first separator, to minimize the size of equipment in the overhead stream.

In a further embodiment said polar stream of wash water comprising ammonium halides is directed to a means of concentrating, to provide a stream of purified water and a stream of brine having a concentration of ammonium halides being more than 2 times, 5 times or 10 times and less than 50 times or 100 times above that of the polar stream of wash water comprising ammonium halides. This has the benefit of reducing the amount of wash water consumed by the process and the amount of waste water generated by the process, which is especially relevant if the weight ratio between wash water and hydrocarbon product stream water is above 1:10, 1:5 or 1:2 such as up to 1:1, 2:1 or 10:1.

In a further embodiment relates to a process for conversion of a raw feed stream rich in molecules comprising C, H, N and one or more halides, and optionally O, Si, and other elements, said process comprising i. a step of thermal decomposition of said raw feed stream, to provide a precursor to a hydrocarbonaceous feed or a hydrocarbonaceous feed,
ii. optionally a step of pre-treatment, purifying the precursor to hydrocarbonaceous feed to provide the hydrocarbonaceous feed
iii. a hydrotreatment step for converting the hydrocarbonaceous feed in the presence of hydrogen, in accordance with any of the previous claims, to provide a hydrocarbon product stream.

This has the associated benefit of converting a raw feed stream of low value to a hydrocarbon product stream suitable for further processing.

In a further embodiment said raw feed stream is as a mixture rich in plastic, lignin, straw, lignocellulosic biomass, halide contaminated waste oils or aquatic biological material. This has the associated benefit of transforming such inexpensive or greenhouse gas emission favorable raw materials into a valuable purified hydrocarbon.

In a further embodiment said hydrotreatment step is followed by the step of directing the hydrocarbon product and/or the bottoms stream to a steam-cracking process. This has the associated benefit of providing a raw material for petrochemical processes, from e.g. waste products, biological material or low-cost resources by the steam cracking process which is well suited for providing e.g. alkenes for downstream processing, such as production of polymers.

A further aspect relates to a system for hydrotreatment of a hydrocarbonaceous stream comprising (a) a hydrotreatment reactor containing a material catalytically active in hydrotreatment, said hydrotreatment reactor comprising an inlet for introducing a hydrogen enriched hydrocarbon stream and an outlet for withdrawing a first hydrocarbon product stream,
(b) a first means of separation having at least an inlet, an overhead outlet and a bottoms outlet,
(c) a means of mixing having two inlets and an outlet,
(d) a second means of separation, having an inlet and a liquid polar phase outlet, liquid non-polar phase outlet and gas phase outlet, wherein said outlet for withdrawing a first product stream is in fluid communication with the inlet of said first means of separation, wherein said overhead outlet is in fluid communication with the inlet of said first inlet of the means of mixing, wherein a source of water is in fluid communication with the second inlet of the means of mixing, wherein the outlet of the means of mixing is in fluid communication with the inlet of the second means of separation and wherein at least one of the bottoms outlet of the first means of separation and the liquid non-polar phase outlet of the second means of separation is in fluid communication with a hydrocarbon product outlet or a hydrocarbon fractionator inlet.

This system has the associated benefit of being well suited for hydrotreatment with purification of the product hydrocarbon stream and the bottoms stream, minimizing the equipment required to be made of high grade steel.

In a further embodiment of said system for hydrotreatment of a hydrocarbonaceous stream, said first means of separation is a stripper further having a stripping medium inlet. Such a system has the associated benefit of the stripping medium driving dissolved gases, such as ammonia and inorganic halides out of the liquid phase of the hydrocarbon product stream.

In a further embodiment said system for hydrotreatment of a hydrocarbonaceous stream further comprises a means of concentrating, having an inlet, a concentrated brine outlet and a purified water outlet, and the liquid polar phase outlet of the means of separation is in fluid communication with the inlet of the means of concentrating, wherein the purified water outlet of the means of concentrating is in fluid communication with a second inlet of the means of mixing optionally in combination with a further source of purified water and wherein the liquid non-polar phase outlet of the means of phase separation is configured for providing a hydrocarbon product. This system has the associated benefit of being well suited for hydrotreatment with purification of the product hydrocarbon stream with an even further reduced consumption of water.

The process and the system disclosed may be found useful where the feed to a hydrotreatment process comprises halides. Examples of such feeds include the products of processes such as hydrotreatment of the product from thermal decomposition of halide rich materials, such as waste plastic, comprising e.g. PVC or other halide containing plastics as well as of biological materials with high halide content, e.g. straw and algae, as well as other products of thermal decomposition or hydrothermal liquefication processes, kerogenic feeds such as coal tar or shale oil. The feed comprising halides may also originate from non-pyrolyzed renewable feedstocks, e.g. waste cooking oil, algae lipids, especially when grown in salt water, or other biological feeds comprising hydrocarbons, nitrogen and chloride.

Ammonia and halides react to form salts, e.g. ammonium chloride, at temperatures below the precipitation temperature typically 150° C. to 300° C. Precipitation of such salts may result in partial or complete or partial blocking of process lines as well as potential corrosion and must therefore be avoided. Therefore, it is also relevant to be aware of this aspect when defining the process conditions.

After the hydrotreatment of a halide containing hydrocarbonaceous feedstock, a mixed product stream rich in inorganic halides, will be present. Depending on the boiling range and the process temperature and pressure, the stream may be a one-phase gas stream or a two-phase stream with a gas stream rich in hydrogen and hydrogenated hetero-atoms, such as hydrogenchloride and ammonia and a liquid stream comprising mainly hydrocarbons. In the latter case, separating the two-phase stream and minimizing the amount of hydrogen halides in the liquid stream comprising hydrocarbons will put fewer demands to corrosion resistance in the choice of materials in process equipment handling this stream.

As the hydrogenated hetero-atoms are water soluble, addition of an amount of wash water and cooling the stream, will result in a three-phase stream, comprising a gas phase, an organic non-polar phase and an aqueous polar-phase, which may be separated in a so-called three-phase separator, possibly in combination with a cascade of separators with intermediate cooling and pressure release.

If the hydrocarbonaceous feedstock comprises an amount of nitrogen, the mixed product stream from hydrotreatment would also comprise an amount of ammonia. Ammonia and halides may react to form ammonium halide, such as ammonium chloride, which is easily formed and which rapidly solidifies under the appropriate conditions, which are mainly dictated by a precipitation temperature, approximately corresponding to the sublimation temperature of ammonium halide. The precipitation temperature is dependent on concentrations and pressure in accordance with thermodynamic principles.

In traditional refinery processes such a water washing process step is also seen, e.g. in the context of nitrogen rich hydrocarbons, which are converted to ammonia, which is highly soluble in water, and which enables withdrawal of hydrogen sulfide as ammonium bisulfide in the wash water. The concentration of nitrogen hetero-atoms may be above 1 wt %, and the mass ratio of water consumed to hydrocarbon to is typically 1:20 or 1:10, resulting in a concentration of ammonia salts in water around 1 wt % to 5 wt %. This design is limited by the concentration of ammonium bisulfide; however, this concentration is allowed to be up to 2 wt % to 4 wt % before corrosion becomes an issue.

In a process where halides are among the hetero-atoms of a hydrocarbonaceous feed, and where they are present in levels above 100 $ppm_w$, it is however necessary to increase the amount of water in the washing process, to achieve quantitative withdrawal of halides from the non-polar phase, while avoiding corrosion issues from elevated halide concentration in the water phase. With a feedstock comprising 500 $ppm_w$ Cl and a purified hydrocarbon comprising less than 1 $ppm_w$ Cl, the mass ratio of water to hydrocarbon may be about 1:1, as typical design limits requires keeping Cl levels in the water below 500 $ppm_w$, which corresponds to the requirement for carbon steel or higher alloy steel depending on temperature and pH. This amount of water is 10 to 20 times higher than the normal practice in the refinery industry. If $NH_3$ or another base is present in the stream, the pH will be higher, and the sensitivity towards presence of Cl will be reduced.

Such a high amount is of course an economical and environmental challenge, and therefore it is desirable to reduce the amount of water consumed. This may be done by providing a means of concentration of the used wash water, such that it is separated in purified wash water and a concentrated brine rich in impurities, such as halides. Multiple methods exist for this purpose, including membrane filtration, reverse osmosis or evaporation, including falling film evaporation. The equipment used in the evaporation process will be much more expensive if special grades of steel are required, so it is also beneficial to consider reducing the corrosiveness of the used wash water, e.g. by neutralizing the used wash water. As the wash water in presence of halides typically is acidic, e.g. as low as pH=2 for hydrocarbonaceous feedstocks with a low amount of nitrogen, addition of ammonia or sodium hydroxide, either in the wash water or to a stream downstream the addition of wash water, may be used to bring pH to a value in the range 6.5-9.0, which is puts less requirement to materials.

To minimize presence of halides, the hydrocarbon stream must be purified to high extent. This may be done by separating the mixed product stream in a high boiling hydrocarbon product, which does not contain relevant amounts of the inorganic gases ammonia or halides and a gaseous product stream comprising essentially all of the inorganic gases. Such a separation may be carried out in equipment of simple design, e.g. a flash drum, which typically will be sufficient if the concentration of chlorides is below 10 ppm.

Gas/liquid separation in a flash drum, will have an efficiency corresponding to the solubility and Henry's law. This will mean that an equilibrium amount of HCl will remain in the liquid phase. At 260° C., 14 MPa the distribution of HCl between liquid and gas is 1:2.7 and accordingly, 6 $ppm_{wt}$ HCl in the inlet to a flash drum will at 260° C., 14 MPa, a be separated in such that 73% HCl (2.7/(1+2.7)) enters the gas phase, and the remaining 27% will remain as 1.7 $ppm_{wt}$ in the liquid phase. In a subsequent low temperature fractionator, this remaining HCl will be released to a gas stream together with $NH_3$. This gas stream may contain around 1 $ppm_w$t HCl, which corresponds to a $NH_4Cl$ precipitation temperature around 180° C. which typically will not pose a problem, as the temperature may be controlled to avoid cold spots and due to the limited amount of $NH_4Cl$ for precipitation, and therefore such operation is common in traditional fossil refinery plants.

However, if instead a stream containing 1000 $ppm_w$t HCl is to be separated in a flash drum at 260° C., 14 MPa, approximately 73% HCl will still enter the gas phase, and the remaining 27% will remain as 270 ppmwt in the liquid phase. In a subsequent low temperature fractionator, this remaining HCl will be released to a gas stream together with $NH_3$. This gas stream may contain around 200 $ppm_{wt}$ HCl, which corresponds to a $NH_4Cl$ precipitation temperature around 230° C. which requires maintaining cold spots around the low temperature fractionator at a higher temperature and providing a much higher amount of $NH_4Cl$ available for precipitation. Therefore, the risk of precipitation and corrosion is much higher.

If the pressure is reduced from e.g. 14 MPa to 6 MPa, the liquid:gas distribution becomes 1:8.2, and thus 89% HCl enters the gas phase, and only 11% remains in the liquid phase, which would be 0.6 $ppm_{wt}$ and 110 $ppm_{wt}$ respectively, which still is prohibitively high for the naphtha stream comprising 1000 $ppm_{wt}$ HCl.

The purity of the high boiling hydrocarbon product will however be higher if a stripping medium is directed to the high boiling hydrocarbon stream, to drive out any gases.

To avoid precipitation of ammonium halides in or downstream the separation equipment it is necessary to operate the stripper at an elevated temperature, above the precipitation temperature of the ammonium halides potentially formed from the ammonia and halides present in the stripper overhead stream, i.e. above 150-230° C. or even higher, contrary to the regular operation of a strippers in refinery plants, where they typically operate below or slightly above the boiling point of water, especially if the objective is to drive out gases, since operation of a stripper at elevated temperature will result in an increased loss of product. The required stripper outlet temperature is non-linearly dependent on the concentration of $NH_3$ and HCl in the released gas phase, and therefore the gaseous output of the stripper must be kept above the precipitation temperature, until the gas is washed by contact with washing water.

The product of the process may be directed to further treatment, either for the production of hydrocarbon transportation fuel of for petrochemical processes, i.e. in a steamcracker.

BRIEF DESCRIPTION OF THE FIGURE

FIG. 1 discloses a system for treating a hydrocarbon stream.

DETAILED DESCRIPTION OF THE FIGURE

FIG. 1 discloses a system for treating hydrocarbons. Even though some heat exchange units, pumps and compressors are shown in FIG. 1, further pumps, heaters, valves and other process equipment may be part of the system of FIG. 1.

The system of FIG. 1 comprises a sub-system for removing halides from a hydrocarbon stream before the hydrocarbon stream enters a final stripper and/or fractionation section.

FIG. 1 shows a hydrocarbon stream 2 containing a halide such as chlorine. This stream is optionally preheated, before being combined with a hydrogen rich gas stream 6 to a hydrogen enriched hydrocarbon stream 10 in order to ensure the provision of the required hydrogen for the hydrogenation of di-olefins in first reactor 16. The hydrogen enriched hydrocarbon stream 10 is heated in heat exchanger 12, and optionally by further heating such as a fired heater to form a heated hydrogen enriched hydrocarbon stream 14. The first reactor 16 is optional but may have operating conditions at a pressure of 30 Barg to 150 Barg and a temperature of about 180° C., suitable for hydrogenation of di-olefins. The first reactor 16 contains a material catalytically active in olefin saturation and hydro-dehalogenation. Within the first reactor 16, the heated hydrogen enriched hydrocarbon stream 14 reacts at the presence of the catalytically active material, rendering a first hydrogenated product stream 18.

The first hydrogenated product stream 18 is heated, e.g. in a fired heater 20, and transferred as a heated first hydrogenated product stream 22 to a second reactor 24 where it reacts at the presence of a second catalytically active material. Often quench gas 26 is provided to the second reactor to control the temperature, since hydrogenation reactions typically are very exothermic. The first and second catalytically active material may be identical or different from each other and will typically comprise a combination of sulfided base metals such as molybdenum or tungsten promoted by nickel or cobalt supported on a refractory support such as alumina or silica. Typically, the reaction over the first catalytically active material is dominated by saturation of di-olefins, whereas the reaction over the second catalytically active material is dominated by saturation of mono-olefins and hydro-dehalogenation of halide-hydrocarbons, but also hydrodesulfurization, hydrodenitrogenation and hydrodeoxygenation may take place in the second reactor 24, depending on the composition of the feedstock. Therefore, the hot mixed product stream 28 may comprise hydrocarbons, $H_2O$, $H_2S$, $NH_3$ and HCl, which may be withdrawn by washing and separation. The hot product stream 28 is cooled moderately in heat exchanger 32 to form a cooled product stream 30 having a temperature above the precipitation temperature of the mixed product stream. The cooled product 30 is directed to a hot stripper 40 where separation is aided by a stripping medium 42. The cooled product 30 is split in a gas product fraction 44 and a liquid product fraction 46. The gas product fraction 44 is combined with a stream of purified water 50, providing a mixed stream 52 and cooled in cooler 54, providing a three-phase stream 56, which is separated in three-way separator 58, into a light hydrocarbon stream 60, a contaminated water stream 62 and a hydrogen rich gas stream 66. The hydrogen rich gas stream 66 is directed to a recycle compressor 68 and directed as quench gas 26 for the second reactor 24 and as stripping medium 42 for the hot stripper 40, as well as recycle gas 8 to be combined with make-up hydrogen gas 4, forming hydrogen rich gas 6.

The light hydrocarbon stream 60 exiting the three-phase separator 58 enters a second stripper 48 to further separate liquid and gaseous components, with the aid of a stripping medium 72. The light ends output 78 from the second stripper 48 is cooled in cooler 80 and directed as a cooled light ends fraction 82 to a further three-phase separator 84 arranged to separate an off-gas fraction 86 from a polar liquid fraction 88 and a hydrocarbon liquid fraction 92. The hydrocarbon liquid fraction 92 from the further three-phase separator 84 is recycled to the second stripper 48, the polar liquid fraction 88 can be combined with the contaminated water stream 62 and be directed to a means of concentrating 96, from which a stream of concentrated brine 98, rich in e.g. $NH_4Cl$, as well as a stream of purified water 50, comprising a low amount of impurities such as $NH_4Cl$, are withdrawn. The purified water may, typically together with an added amount of water, be added as pure wash water 50.

The invention claimed is:

1. A process for conversion of a hydrocarbonaceous feed comprising at least 10 ppmw and less than 10000 ppmw of one or more halides, and at least 20 ppmw and less than 10000 ppmw organically bound nitrogen, to a hydrocarbon product stream by hydrotreatment, under effective hydrotreatment conditions, in the presence of a material catalytically active in hydrotreatment and an amount of hydrogen, wherein said conversion provides a mixed product stream comprises an amount of ionic halides and an amount of ammonia, said process comprising the steps of a) separating in a stripping process at a first separation temperature the mixed product stream to provide an overhead stream and a bottoms stream, b) combining the overhead stream with an amount of wash water and c) separating in a second separation step the combined overhead stream and wash water in a non-polar stream of hydrocarbon product and a polar stream of wash water comprising ammonium halides, wherein the first separation temperature being above the precipitation temperature of the ammonium halides present in the mixed product stream.

2. A process according to claim 1 wherein said stripping process employs hydrogen, steam, methane or nitrogen as a stripping medium.

3. A process according to claim 1 wherein the temperature of said first separation step is above 280° C.

4. A process according to claim 1 wherein the temperature of said first separation step is below the temperature at which 30% of the mixed product stream boils.

5. A process according to claim 1, wherein said polar stream of wash water comprising ammonium halides is directed to a means of concentrating, to provide a stream of purified water and a stream of brine having a concentration of ammonium halides being more than 2 times and less than 100 times above that of the polar stream of wash water comprising ammonium halides.

6. A process for conversion of a raw feed stream rich in molecules comprising C, H, N and one or more halides, and optionally O, Si, and other elements, said process comprising:

i. a step of thermal decomposition of said raw feed stream, to provide a precursor to a hydrocarbonaceous feed or a hydrocarbonaceous feed, ii. optionally a step of pre-treatment, purifying the precursor to hydrocarbonaceous feed to provide the hydrocarbonaceous feed, and iii. a hydrotreatment step for converting the hydrocarbonaceous feed in the presence of hydrogen, in accordance with claim 1, to provide a hydrocarbon product stream.

7. A process according to claim 1, wherein the raw feed stream or the hydrocarbonaceous stream originates from a mixture rich in plastic, lignin, straw, lignocellulosic biomass, halide contaminated waste oils or aquatic biological material.

8. A process according to claim 1, followed by the step of directing the hydrocarbon product and/or the bottoms stream to a steam-cracking process.

9. A system for hydrotreatment of a hydrocarbonaceous stream comprising a) a hydrotreatment reactor containing a material catalytically active in hydrotreatment, said hydrotreatment reactor comprising an inlet for introducing a hydrogen enriched hydrocarbon stream and an outlet for withdrawing a first hydrocarbon product stream, b) a first means of separation having at least an inlet, an overhead outlet and a bottoms outlet, c) a means of mixing having two inlets and an outlet, d) a second means of separation, having an inlet and a liquid polar phase outlet, liquid non-polar phase outlet and gas phase outlet, wherein said outlet for withdrawing a first product stream is in fluid communication with the inlet of said first means of separation, wherein said overhead outlet is in fluid communication with the inlet of said first inlet of the means of mixing, wherein a source of water is in fluid communication with the second inlet of the means of mixing, wherein the outlet of the means of mixing is in fluid communication with the inlet of the second means of separation and wherein at least one of the bottoms outlet and the liquid non-polar phase outlet is in fluid communication with a hydrocarbon product outlet or a hydro-carbon fractionator inlet.

10. A system for hydrotreatment of a hydrocarbonaceous stream according to claim 9, where said first means of separation is a stripper further having a stripping medium inlet.

11. A system for hydrotreatment of a hydrocarbonaceous stream according to claim 9 further comprising a means of concentrating, having an inlet, a concentrated brine outlet and a purified water outlet, and the liquid polar phase outlet of the means of separation is in fluid communication with the inlet of the means of concentrating, wherein the purified water outlet of the means of concentrating is in fluid communication with a second inlet of the means of mixing optionally in combination with a further source of purified water and wherein the liquid non-polar phase outlet of the second means of separation is configured for providing a hydrocarbon product.

12. A process according to claim 1, wherein the temperature of said first separation step is above 150° C.

* * * * *